US005830088A

United States Patent [19]

Franklin de Abreu

[11] Patent Number: 5,830,088

[45] Date of Patent: Nov. 3, 1998

[54] PORTABLE BASKETBALL RETURN DEVICE

[76] Inventor: Paulo G. Franklin de Abreu, Rua Taranto 40 Bandeirantes-Pampulha, Belo Horizonte, Brazil, CEP 31340550

[21] Appl. No.: 981,417

[22] PCT Filed: Jul. 8, 1996

[86] PCT No.: PCT/BR96/00030

§ 371 Date: Dec. 16, 1997

§ 102(e) Date: Dec. 16, 1997

[87] PCT Pub. No.: WO97/02869

PCT Pub. Date: Jan. 30, 1997

[51] Int. Cl.[6] ..... A63B 69/00

[52] U.S. Cl. ..... 473/433; 473/447

[58] Field of Search ..... 473/433, 447, 473/448

[56] References Cited

U.S. PATENT DOCUMENTS

| | | | |
|---|---|---|---|
| 3,901,506 | 8/1975 | Caveney | 473/433 |
| 4,678,189 | 7/1987 | Koss | 473/433 |
| 4,697,810 | 10/1987 | Mathison | 473/433 |
| 4,838,549 | 6/1989 | Woodall | 473/433 |
| 4,913,431 | 4/1990 | Jakobs | 473/433 |
| 4,936,577 | 6/1990 | Kington et al. | 473/433 |
| 4,955,605 | 9/1990 | Goldfarb | 473/433 |
| 5,016,875 | 5/1991 | Joseph | 473/433 |
| 5,100,133 | 3/1992 | Riviezzo et al. | 473/433 |
| 5,129,648 | 7/1992 | Sweeney et al. | 473/433 |
| 5,165,680 | 11/1992 | Cass | 473/433 |
| 5,171,009 | 12/1992 | Filewich et al. | 473/433 |
| 5,265,870 | 11/1993 | Merino | 473/433 |
| 5,312,099 | 5/1994 | Oliver, Sr. | 473/433 |
| 5,348,290 | 9/1994 | Matherne et al. | 473/433 |
| 5,354,048 | 10/1994 | Winesberry, Jr. | 473/447 |
| 5,368,292 | 11/1994 | Metz | 473/433 |
| 5,409,211 | 4/1995 | Adamek | 473/433 |
| 5,443,258 | 8/1995 | Kinsella | 473/433 |
| 5,540,428 | 7/1996 | Joseph | 473/433 |
| 5,746,668 | 5/1998 | Ochs | 473/433 |

*Primary Examiner*—William H. Grieb
*Attorney, Agent, or Firm*—Dowell & Dowell, P.C.

[57] ABSTRACT

A portable basketball return device which includes arms that hold a net which is adapted to surround an existing basketball hoop thus enabling the device to catch a ball that passes through or adjacent to the hoop to be redirected toward a shooter.

8 Claims, 2 Drawing Sheets

PORTABLE BASKETBALL RETURN DEVICE

The present invention relates to the practice of basketball shots. It returns the ball to the shooter whether he was successful or not, no matter where he is in the square place. In addition it counts how many balls were shot and how many of them were successful. Thus, the player that practices shoots can make more shoots in a given period of time, because the time he used to spend getting the ball after the shoots is now saved. It can be easily installed in whatever basketball backboard and hoop. When disassembled, it can be carried only with one hand.

The basketball shooting practice can happens in many ways: sometimes the player stays in a position of the square, shoots a given quantity of times from a determinate position of the square, then moves to another place and starts shooting again the same quantity of times. Some players like to practice shooting the ball only one time from each position, or even they use to kick the ball from one position to another before the shoot. What these different ways of practicing have in common is that the shooting player needs a fellow player to retrieve the ball to him, if not, the player spends much more time retrieving the ball than practicing shoots.

Until now, some efforts have already been made to develop an apparatus to do this job. Among the patents related with this subject we have Filewich U.S. Pat. No. 5,171,009, Kington U.S. Pat. No. 4,936,577 and Metz U.S. Pat. No. 5,368,292. The Filewich patent consists in a support member, a backboard mounted on the support member, and a hoop mounted on the backboard. The backboard is mounted on the support member for rotation with respect thereto, wherein the backboard is located in selected angular positions with respect to a predetermined location that is disposed remote from the support member and the backboard mounted thereon. In addition, it also counts and records the number of shoots and successful shoots. Although the apparatus can be compacted it has an concept that doesn't enables the player to easily carry it to different places to practice the shoots.

The Metz patent is highly suited for the practice of free throws and other perpendicular direct shoots. It interferes in the perpendicular indirect shoot. It has an upper ring that supports a net that catches the unsuccessful shots. His upper ring can get in the way of the ball's trajectory. The Kington patent has similar problems. Because of the upper ring it is recommended for shoots from the three point line.

As a reference there are other granted patens as listed below, but, again, none of them has the concept of the present invention: Caveney U.S. Pat. No. 3,901,506; Jakobs U.S. Pat. No. 4,913,431; Woodall U.S. Pat. No. 4,838,549; Joseph U.S. Pat. No. 5,016,875; Sweeney U.S. Pat. No. 5,129,648; Koss U.S. Pat. No. 4,678,189; Oliver U.S. Pat. No. 5,312,099. There are other patents related with this subject but most of them are able to retrieve the balls that successfully passed through the basketball hoop. In addition most of the patents are big enough to prevent the player to kick the ball in wherever place of the square before shooting .

The present invention has been developed with the aim of solving all the problems mentioned above and other that hadn't been thought yet. With its new concept, the basketball player can practice shoots wherever he wants and with the advantage of easy mounting (it can be carried with one hand, when disassembled) and installation, as will be explained below. In addition it counts how many balls have been successfully shot and the total of shoots. Still, it has more advantages than the existing patents: the player can shoot directly or indirectly, when installed in the existing backboard/hoop and the floor is let free for him. It doesn't interfere on the ball trajectory due to its adjustable net supported by mobile arms. The arms are adjusted automatically depending on the direction that the retrieval device is set The retrieval direction can be adjusted by distance. It is disassembled in such a way that it can be carried inside one little bag.

It's good to remember that the following drawings and explanations don't limit the claims of this invention. This patent can be improved within the basic concept of the invention, like the mobile arms that sustain the net, the upper and lower rings (positioned just below an existing basketball hoop) that are responsible for the apparatus working. The basic principle is that the net is automatically adjusted by the rotative retrieving device.

The main features of the present invention are: fixed and mobiles arms, that surrounds an existing basketball hoop, to support a net that has the function of catching the ball that didn't got into the basketball hoop. A ring placed just below the existing basketball hoop that collects the balls from the apparatus's net or directly from the basketball hoop. At the same time it supports the flexible arms and the lower ring that rotates just below it. This lower ring has two main functions: support the retrieval device (that directs the ball to the shooter's location) and move the arms in such a way that the one which is in the direction of the shooter in down. In addition, the retrieval direction (consequently the arms/net adjustment) can be changed by the player by distance. Also, there are two counters: one placed below the existing basketball hoop, to count the successful shoots, and the other placed in the retrieval device, to count the total shoots.

The invention can be better described by the detailed explanation and drawings, as follows.

Figure 1:
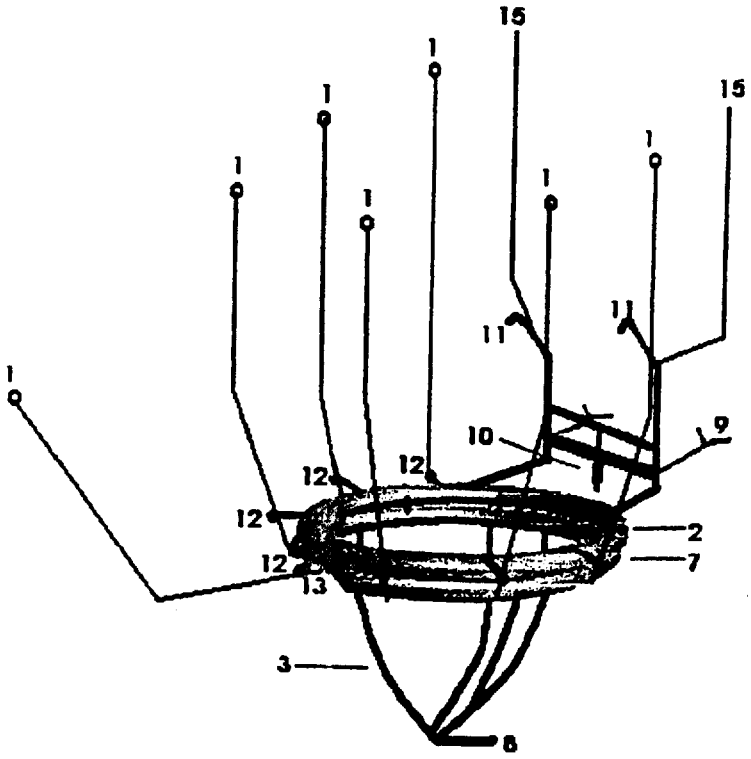
FIG. 1 is an overview of the invention although it has only the main parts for better understanding.

The apparatus consists in arms (1) that sustains a net (14), surrounding an existing basketball hoop, thus enabling the apparatus to catch the shot ball that re-cocheted the hoop and/or backboard to any direction and the successful ones. The arms stays in two positions: down or upright, in such a way that the one that is turned towards the same direction of the retrieval device (3) is down and all the other are upright. The device that set the arms in motion is the rotative lower ring (7) that supports the retrieval device (3). This last ring rotates concentricly with the upper ring (2), that supports the arms (1). The retrieval device (3), redirects the ball to the shooter. It can be adjusted in two different ways: the player, placed below the apparatus, can put the hand upwards and turn it by holding an appropriate part (8), or he can hold himself with a rope (4) connected with a spool (5) that is placed in the upper part of the retrieval device (3), just below the upward section of the ring (13) allowing, thus, the retrieval device to be adjusted by distance. Also, there are two counter (6): one is placed just below the existing basketball hoop (this one counts the successful shoots), and the other is placed in the retrieval device (that counts how many ball were shot).

Considering now, each drawing, the FIG. 1 is an overview of the invention although it has only the main parts for better understanding. The arms that support the net (14) are disposed surrounding the existing basketball hoop so that the unsuccessful balls are caught. The ball goes, by gravity, to the upper ring (2), and then to the retrieval device (3) from where it is relounched to the shooter's direction. Still in FIG. 1 there are two hooks (11) that are used to hang the apparatus in the back side off an existing basketball hoop. In the same drawing there is a part (9) that matches with the lowest border of the backboard to assure stability. There is also an height adjustment device (10) that allows the apparatus to be suitable to different forms/sizes of unofficial backboards.

Figure 2:
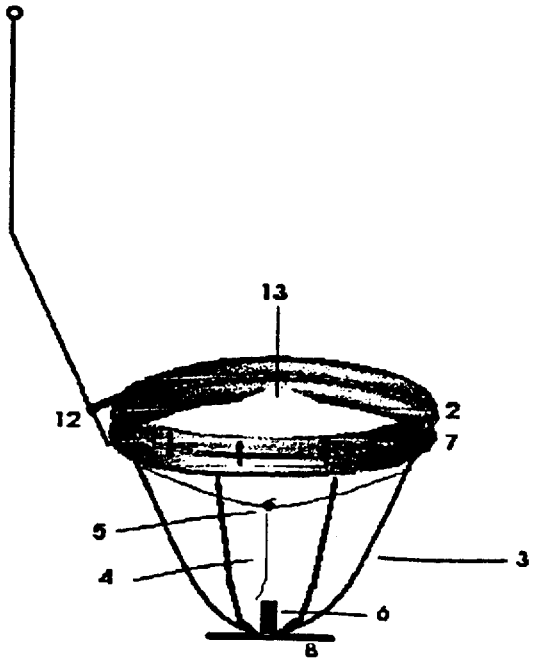
FIG. 2 is a front view of the upper and lower rings that explains the conjoint motion of arms and the retrieval device.

In FIG. 2, it can be seen the retrieval device that is composed by two "U" shaped parts: the one in the middle is the main responsible to retrieve the ball; the other, that has a shape more widely opened is joined with the first one in the lowest extremity. This junction is not fixed in such a way that they can be disassembled and at the same time allowing the player to adjust the exit angle of the device (3). The retrieve device (3) is supported by the lower ring (7), but they can also be disassembled. This figure shows how the arms moves in accordance with the direction of the retrieval device (3). There is a pivot (12) that links the arms to the upper ring (2). When the rotative lower ring (7), is put in motion by the retrieval device (3), the lowest extremity of the arm slides on it, touches the upward section of the lower ring (13), that is situated above the lowest extremity of the retrieval device (3). Thus, the upper extremity of this arm goes down until it reaches the same level of the existing basketball hoop, enabling the shooter a good view of it and providing a free way to the ball's trajectory.

Figure 3:
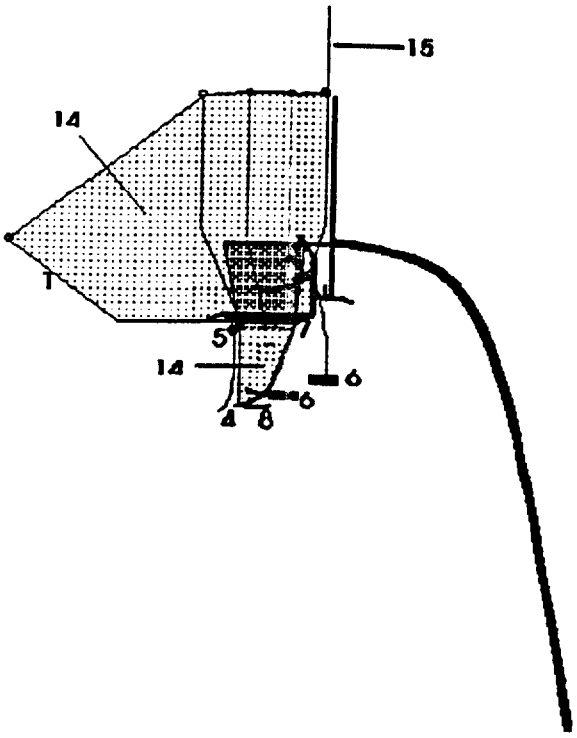
FIG. 3 is a side view of the invention, already installed in an existing backboard and hoop.

In FIG. 3, it can be seen the apparatus installed on an existing basketball backboard and hoop. In this position the player is ready to practice "free throws". Both, the retrieval device and the middle arm are positioned to free throws practice. (see also FIG. 1). There is also a net (14) that involve the retrieval device.

Figure 4:
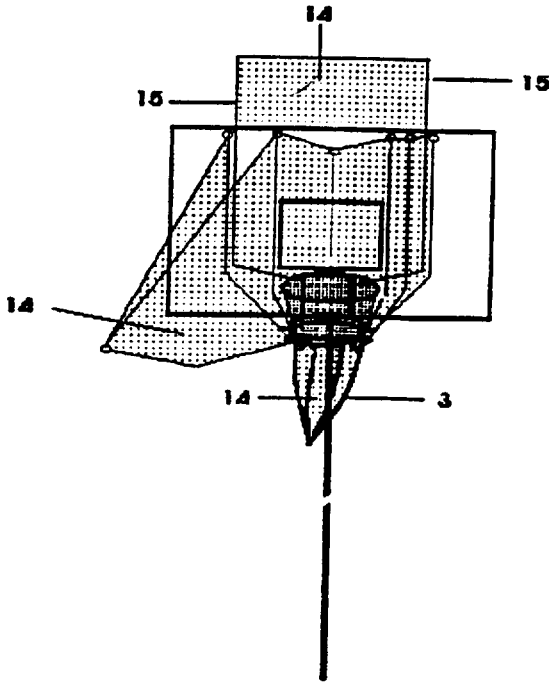
FIG. 4 is a front view of the invention positioned to receive oblique shoots.

The FIG. 4 is a front view of the invention positioned to receive oblique shoots. Above the backboard it can be seen a net (14) supported by fixed arms (15) that goes up along the backboard. This upper net avoids that the ball goes backward after kicking the hoop.

I claim:

1. A portable basketball return device comprising arms (1) that hold a net (14) which is adapted to surround an existing basketball hoop, thus enabling the device to catch a ball that passes through or adjacent to the hoop wherein the arms are adjustable to extend vertically down or upright, in such a way that an arm which is turned towards a direction of a retrieval device (3) which is connected thereto is down and the others are upright, the arms being adjusted by a lower ring (7) that supports the retrieval device (3) and which rotates concentricly with an upper ring (2) that supports the arms (1), said retrieval device thereby being manually or mechanically adjustable by way of a rope (4) and spool (5) to redirect a ball toward a shooter.

2. A portable basketball return device in accordance with claim 2, is characterized in that the net, supported by mobile arms (1) is automatically put in motion when the player re-directs the retrieval device (3).

3. A portable basketball return device in accordance with claim 2, is characterized by two counters (6) that count how many balls were shot and among them how many passed through the existing basketball hoop.

4. A portable basketball return device in accordance with claim 2 characterized by the fact that it's unique simple concept that allows the player to transport it with only one hand due to the fact that it is totally dismounted.

5. A portable basketball return device in accordance with claim 2, is characterized by the existence of another net adapted to be placed above a basketball backboard supported by fixed arms that also support the same net of the adjustable arms.

6. A portable basketball return device in accordance with claim 2, is characterized by two hooks (11) that are used to hang the apparatus in the back side off an existing basketball hoop and for a part (9) that matches with the lowest border of the backboard to assure stability and wherein a height adjustment device (10) allows the device to be suitable to different forms/sizes of backboards.

7. A portable basketball return device, in accordance with claim 2, is characterized by the fact that a player can shoot directly or indirectly because the device does not interfere on a ball's trajectory due to its adjustable net supported by adjustable arms.

8. A portable basketball return device in accordance with claim 2, is characterized by the fact that the device is adapted to be mounted to an existing backboard/hoop above a floor.

* * * * *